US006286483B1

(12) United States Patent
Lei et al.

(10) Patent No.: US 6,286,483 B1
(45) Date of Patent: Sep. 11, 2001

(54) FUEL INJECTOR WITH ACTUATION PRESSURE DELAY DEVICE

(75) Inventors: Ning Lei, Oak Brook; Xilin Yang, Elk Grove Village, both of IL (US); John F. Thuente, St. Paul, MN (US)

(73) Assignee: International Truck and Engine Corporation, Chicago, IL (US)

( * ) Notice: Subject to any disclaimer, the term of this patent is extended or adjusted under 35 U.S.C. 154(b) by 0 days.

(21) Appl. No.: 09/553,002

(22) Filed: Apr. 19, 2000

Related U.S. Application Data

(60) Provisional application No. 60/130,055, filed on Apr. 19, 1999.

(51) Int. Cl.[7] ..... F02M 7/00; F02M 37/64

(52) U.S. Cl. ..... 123/446; 123/496

(58) Field of Search ..... 123/446, 447, 123/496, 500, 501

(56) References Cited

U.S. PATENT DOCUMENTS

| | | | | |
|---|---|---|---|---|
| 5,597,118 | | 1/1997 | Carter, Jr.et al. . | |
| 5,655,501 | * | 8/1997 | Hafner | 123/496 |
| 5,682,858 | | 11/1997 | Chen et al. . | |
| 5,697,341 | * | 12/1997 | Ausman et al. | 123/446 |
| 5,720,261 | | 2/1998 | Sturman et al. . | |
| 5,720,318 | | 2/1998 | Nagarajan et al. . | |
| 5,826,562 | | 10/1998 | Chen et al. . | |

OTHER PUBLICATIONS

S.F.Glassey, et al., Heui–A New Direction for Diesel Engine Fuel Systems, SAE Technical Paper Series, International Congress and Exposition, Mar. 1–5, 1993, pp. 1–11, 930270.

C. Cole et al., Application of Digital Valve Technology to Diesel Fuel Injection, Society of Automotive Engineers, Inc., 1999–01–0196, pp. 1–7.

* cited by examiner

*Primary Examiner*—Thomas N. Moulis
(74) *Attorney, Agent, or Firm*—Dennis Kelly Sullivan; Jeffrey P. Calfa; Gilberto Hernandez

(57) ABSTRACT

A fuel injector including a delay device, the fuel injector having an electric controller for controlling the flow of a high pressure actuating fluid responsive to initiation and cessation of a pulse width command, the pulse width command defining the duration of an injection event, and an intensifier being in fluid communication with the controller, the intensifier being translatable to increase the pressure of a volume of fuel for injection into the combustion chamber of an engine; the delay device includes an apparatus, shiftable between a first disposition and a second disposition over a certain period of time after initiation of the pulse width command, the period of time effecting a delay in initiation of fuel injection after initiation of the pulse width command. In one embodiment, a bias against shifting the apparatus from said first disposition to the second disposition is effected by the actuating fluid to reduce variations in the delay period under variable actuating pressure conditions. A method of stabilizing fuel injection events, includes the steps of sending a pulse width command to a controller to define an injection event, the controller porting an actuating fluid to affect an intensifier responsive to reception of the pulse width command, and interposing a delay in the actuating fluid affecting the intensifier.

48 Claims, 11 Drawing Sheets

FUEL INJECTOR WITH ACTUATION PRESSURE DELAY DEVICE

RELATED APPLICATIONS

The present application claims the benefit of U.S. Provisional Application No. 60/130,055, filed Apr. 19, 1999, incorporated herein in its entirety by reference.

TECHNICAL FIELD

The present invention relates to fuel injectors. More particularly, the present invention relates to hydraulically-actuated, electronically--controlled unit injectors (HEUI injectors).

BACKGROUND OF THE INVENTION

The prior art injectors (baseline) used here for references are the hydraulicallyactuated, electronically-controlled unit injectors described in the following references, which are incorporated herein by reference: SAE paper 930270 and U.S. Pat. Nos. 5,720,261, 5,597,118, and 5,826,562.

The first three above referenced injectors (SAE paper 930270 and U.S. Pat. Nos. 5,720,261, and 5,597,118) do not have any delay device between the control valve and the intensifier. The flow of actuation liquid into the intensifier piston chamber occurs almost immediately after the control valve opens.

The injector of U.S. Pat. No. 5,826,562 delays and limits the initial flow to the intensifier piston by adding throttle slots or a groove on top of the intensifier piston. The opening of the flow passage to the intensifier is controlled by the intensifier piston motion. In the invention of U.S. Pat. No. 5,826,562, flow to the intensifier chamber depends on the traveling velocity of the intensifier. If intensifier can not move fast enough, the flow area then cannot open up. If the flow area cannot open Lip, the intensifier cannot travel faster. This contradiction is the source of a serious limitation of an injector made according to the '562 patent.

Referring to the drawings, FIGS. 7 and 7*a* show a prior art fuel injector 350. The prior art fuel injector 350 is typically mounted to an engine block and injects a controlled pressurized volume of fuel into a combustion chamber (not shown). The prior art injector 350 of the present invention is typically used to inject diesel fuel into a compression ignition engine, although it is to be understood that the injector could also be used in a spark ignition engine or any other system that requires the injection of a fluid.

The fuel injector 350 has an injector housing 352 that is typically constructed from a plurality of individual parts. The housing 352 includes an outer casing 354 that contains block members 356, 358, and 360(not shown). The outer casing 354 has a fuel port 364 that is coupled to a fuel pressure chamber 366 by a fuel passage 368. A first check valve 370 is located within fuel passage 368 to prevent a reverse flow of fuel from the pressure chamber 366 to the fuel port 364. The pressure chamber 366 is coupled to a nozzle 372 through fuel passage 374. A second check valve 376 is located within the fuel passage 374 to prevent a reverse flow of fuel from the nozzle 372 to the pressure chamber 366.

The flow of fuel through the nozzle 372 is controlled by a needle valve 378 that is biased into a closed position by spring 380 located within a spring chamber 381. The needle valve 378 has a shoulder 382 above the location where the passage 374 enters the nozzle 378. When fuel flows into the passage 374 the pressure of the fuel applies a force on the shoulder 382. The shoulder force lifts the needle valve 378 away from the nozzle openings 372 and allows fuel to be discharged from the injector 350.

A passage 383 may be provided between the spring chamber 381 and the fuel passage 368 to drain any fuel that leaks into the chamber 381. The drain passage 383 prevents the build up of a hydrostatic pressure within the chamber 381 which could create a counteractive force on the needle valve 378 and degrade the performance of the injector 350.

The volume of the pressure chamber 366 is varied by an intensifier piston 384. The intensifier piston 384 extends through a bore 386 of block 360 and into a first intensifier chamber 388 located within an upper valve block 390. The piston 384 includes a shaft member 392 which has a shoulder 394 that is attached to a head member 396. The shoulder 394 is retained in position by clamp 398 that fits within a corresponding groove 400 in the head member 396. The head member 396 has a cavity which defines a second intensifier chamber 402.

The first intensifier chamber 388 is in fluid communication with a first intensifier passage 404 that extends through block 390. Likewise, the second intensifier chamber 402 is in fluid communication with a second intensifier passage 406.

The block 390 also has a supply working passage 408 that is in fluid communication with a supply working port 410. The supply port 410 is typically coupled to a system that supplies a working fluid which is used to control the movement of the intensifier piston 384. The working fluid is typically a hydraulic fluid that circulates in a closed system separate from the fuel. Alternatively the fuel could also be used as the working fluid. Both the outer body 354 and block 390 have a number of outer grooves 412 which typically retain O-rings (not shown) that seal the injector 350 against the engine block. Additionally, block 362 and outer shell 354 may be sealed to block 390 by O-ring 414.

Block 360 has a passage 416 that is in fluid communication with the fuel port 364. The passage 416 allows any fuel that leaks from the pressure chamber 366 between the block 362 and piston 384 to be drained back into the fuel port 364. The passage 416 prevents fuel from leaking into the first intensifier chamber 388.

The flow of working fluid into the intensifier chambers 388 and 402 can be controlled by a four-way solenoid control valve 418. The control valve 418 has a spool 420 that moves within a valve housing 422. The valve housing 422 has openings connected to the passages 404, 406 and 408 and a drain port 424. The spool 420 has an inner chamber 426 and a pair of spool ports that can be coupled to the drain ports 424. The spool 420 also has an outer groove 432. The ends of the spool 420 have openings 434 which provide fluid communication between the inner chamber 426 and the valve chamber 434 of the housing 422. The openings 434 maintain the hydrostatic balance of the spool 420.

The valve spool 420 is moved between the first closed position shown in FIG. 7 and a second open position shown in FIG. 7*a* by a first solenoid 438 and a second solenoid 440. The solenoids 438 and 440 are typically coupled to a controller which controls the operation of the injector. When the first solenoid 438 is energized, the spool 420 is pulled to the first position, wherein the first groove 432 allows the working fluid to flow from the supply working passage 408 into the first intensifier chamber 388 and the fluid flows from the second intensifier chamber 402 into the inner chamber 426 and out the drain port 424. When the second solenoid 440 is energized the spool 420 is pulled to the second position, wherein the first groove 432 provides fluid communication between the supply working passage 408 and the second intensifier chamber 402 and between the first intensifier chamber 388 and the drain port 424.

The groove 432 and passages 428 are preferably constructed so that the initial port is closed before the final port is opened. For example, when the spool 420 moves from the first position to the second position, the portion of the spool adjacent to the groove 432 initially blocks the first passage 404 before the passage 428 provides fluid communication between the first passage 404 and the drain port 424. Delaying the exposure of the ports reduces the pressure surges in the system and provides an injector which has more predictable firing points on the fuel injection curve.

The spool 420 typically engages a pair of bearing surfaces 442 in the valve housing 422. Both the spool 420 and the housing 422 are preferably constructed from a magnetic material such as a hardened 52100 or 440c steel, so that the hysteresis of the material will maintain the spool 420 in either the first or second position. The hysteresis allows the solenoids to be de-energized after the spool 420 is pulled into position. In this respect the control valve operates in a digital manner, wherein the spool 420 is moved by a defined pulse that is provided to the appropriate solenoid. Operating the valve in a digital manner reduces the heat generated by the coils and increases the reliability and life of the injector.

In operation, the first solenoid 438 is energized and pulls the spool 420 to the first position, so that the working fluid flows from the supply port 410 into the first intensifier chamber 388 and from the second intensifier chamber 402 into drain port 424. The flow of working fluid into the intensifier chamber 388 moves the piston 384 and increases the volume of chamber 366. The increase in the chamber 366 volume decreases the chamber pressure and draws fuel into the chamber 366 from the fuel port 364. Power to the first solenoid 438 is terminated when the spool 420 reaches the first position.

When the chamber 366 is filled with fuel, the second solenoid 440 is energized to pull the spool 420 into the second position. Power to the second solenoid 440 is terminated when the spool reaches the second position. The movement of the spool 420 allows working fluid to flow into the second intensifier chamber 402 from the supply port 410 and from the first intensifier chamber 388 into the drain port 424.

The head of the intensifier piston 396 has an area much larger than the end of the piston 384, so that the pressure of the working fluid generates a force that pushes the intensifier piston 384 and reduces the volume of the pressure chamber 366. The stroking cycle of the intensifier piston 384 increases the pressure of the fuel within the pressure chamber 366. The pressurized fuel is discharged from the injector through the nozzle 372. The working fluid is typically introduced to the injector at a pressure between 300–4000 psi. In the preferred embodiment, the piston has a head to end ratio of approximately 10:1, wherein the pressure of the fuel discharged by the injector is between –3000–40,000 psi.

Again the fuel is discharged from the injector nozzle 372, the first solenoid 438 is again energized to pull the spool 420 to the first position (FIG. 7) and the cycle is repeated.

In the prior art, the intensifier piston 384 starts to move immediately after control valve 418 starts to open. When a minimum pulse width command (the pulse width defining the time between the open and the close signals to the control valve 418 which permits the spool 420 to fully open (FIG. 7*a*) before being retracted (FIG. 7) which defines the minimum round trip time of the spool 420) is given to the control valve 418, the corresponding fuel delivery amount is referred to as the minimum fuel delivery quantity. This is illustrated in FIG. 4. If a smaller than minimum fuel quantity is desired, the controller would need to command a smaller pulse width which requires the solenoid of the control valve 418 to go through a partial motion, e.g., the spool 420 of the control valve 418 does not achieve a full open (FIG. 7*a*) disposition before it is recalled to its closed disposition (FIG. 7). This is less than a full round trip of the spool 420. However, partial motion of the spool 420 results in poor injector performance due to injector-to-injector variability and injection event-to-event controllability. This causes very rough engine running and undesirable emission levels.

With hydraulically-actuated, electronically-controlled unit fuel injectors (HEUI injector) as described above, the initial portion of an injection event is frequently unstable due to the aforementioned partial motion of the spool 420. Such instability is often induced by partially opening the spool 420 and then abruptly retracting the spool 420. Such partial opening is not very repeatable in a certain injector and is typically not repeatable from injector-to-injector due to manufacturing and other variances. There is a need in the industry for injectors, particularly HEUI injectors, that avoid the noted region of instability.

SUMMARY OF THE INVENTION

The injector of the present invention substantially meets the aforementioned needs of the industry. The object of the present invention is to delay the start of the intensifier actuation process in a hydraulically-actuated, electronically-controlled unit fuel injector (HEUI injector), especially one having a spool-type control valve of the type described in U.S. Pat. No. 5,720,261, by a desired amount of time after the control valve opens. With a certain amount of delay built in between control valve initiation signal and the start of the intensifier motion, it is possible to not have to use control valve partial motion. Further, the unstable motion region that occurs with control valve partial motion is avoided. Hence injection variability is improved with the present invention, especially for very small quantities of fuel delivery. Minimum fuel delivery quantity can be advantageously and significantly reduced even at very high actuation pressure with the present invention.

The present invention is a delay device for use with a fuel injector, the fuel injector having an electric controller for controlling the flow of a high pressure actuating fluid responsive to initiation and cessation of a pulse width command, the pulse width command defining the duration of an injection event, and an intensifier being in fluid communication with the controller, the intensifier being translatable to increase the pressure of a volume of fuel for injection into the combustion chamber of an engine; the delay device includes an apparatus, shiftable between a first disposition and a second disposition over a certain period of time after initiation of the pulse width command, the period of time effecting a delay in initiation of fuel injection after initiation of the pulse width command. In one embodiment, a bias against shifting the apparatus from said first disposition to the second disposition is effected by the actuating fluid to reduce variations in the delay period under variable actuating pressure conditions. The present invention is further a method of stabilizing fuel injection events, includes the steps of sending a pulse width command to a controller to define an injection event, the controller porting an actuating fluid to affect an intensifier responsive to reception of the pulse width command, and interposing a delay in the actuating fluid affecting the intensifier.

DETAILED DESCRIPTION OF THE PREFERRED EMBODIMENTS

Figure 1:
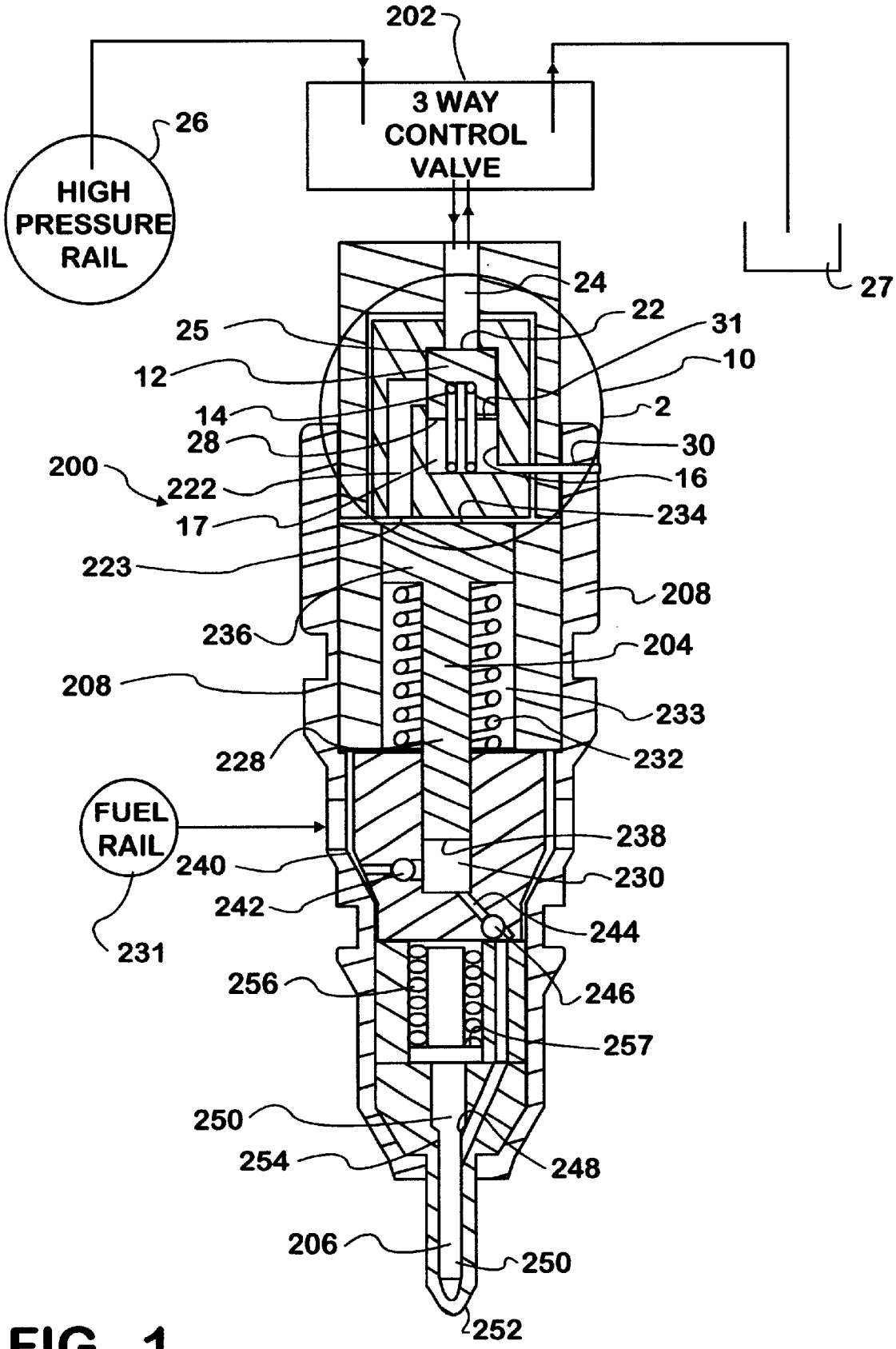
FIG. 1 is a sectional view of a HEUI injector incorporating the delay device of the present invention.
Figure 2A:
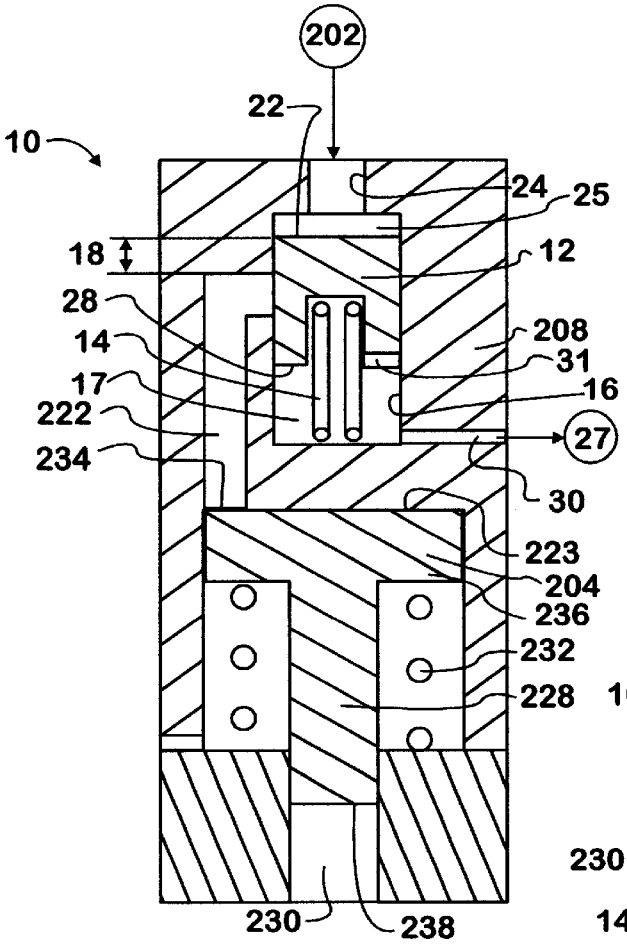
FIG. 2*a* is a sectional view of the delay device depicted in the circle 2 of FIG. 1 during injection delay.
Figure 2B:
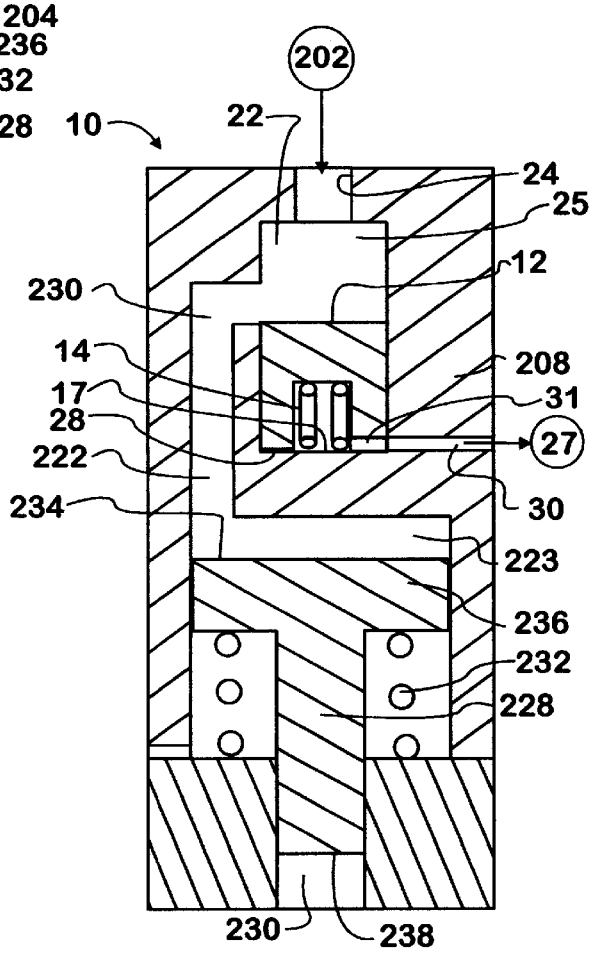
FIG. 2*b* is a sectional view of the delay device depicted in FIG. 2*a* during main injection.

The delay device of the present invention is depicted generally at 10 in the figures. Referring to FIG. 1, the delay device 10 of the present invention is installed in the injector 200 between injector control valve (3-way valve) 202 and the intensifier 204 as shown in FIG. 1. FIGS. 2*a* and 2*b* show the delay device 10 schematic and its operation. FIG. 2*a* depicts the disposition of the delay device 10 for injection delay. FIG. 2*b* depicts the disposition of the delay device 10 for main injection.

The delay device 10 includes delay piston 12, return spring 14 and delay cylinder housing 16. The delay cylinder housing 16 is a stationary piece comprising a cylinder. The delay piston 12 is free to translate up and down inside of the housing 16. As will be described in more detail below, the general operation of the delay piston is such that as the delay piston 12 moves from its top position (FIG. 2*a*) to its bottom position (FIG. 2*b*), the delay piston 12 gradually passes through the delay phase (overlap 18 during which no actuating fluid is ported to the intensifier 204) and gradually opens up the flow passage 222 to the intensifier 204.

As shown in FIGS. 2*a*, 2*b*, the delay piston 12 has top surface 22 which faces the flow the control valve 202 in actuating fluid passageway 24. As the control valve 202 opens, high pressure actuation fluid flows in from the high pressure rail 26 (FIG. 1) through control valve 202. The high pressure actuation fluid flows to bear on the top 22 of the delay piston 12. The top surface 22 of the delay piston 12 is pressurized when the control valve 202 is at its working position (open position). The pressure acting on the top surface 22 of the delay piston 12 is at substantially the same level as the pressure from the high pressure rail 26. This pressure may range from about 500 psi to 3500 psi. In practice, the actuating fluid pressure after the control valve 202 is slightly less than pressure at the rail 26 due to flow resistance and loss at control valve 202.

The bottom side 28 of the delay piston 12 is exposed to ambient pressure by drain 30. A slot 31 defined in the bottom side 28 of the delay piston 12 extends to the drain 30 defined in the injector housing 208. The slot 31 provides the venting of any leakage by the delay piston 12, as well as accessing to ambient pressure.

The flow passageway 222 between the control valve 202 and intensifier chamber 223 is intersected by the delay piston 12 during a portion of the downward travel distance of the delay piston 12. When the delay piston 12 is at its topmost position (FIGS. 1 and 2*a*), the passageway 222 is completely blocked. As the delay piston 12 moves downward, the delay piston 12 must pass through the overlap distance 18 (see FIG. 2*a*) before the delay piston 12 opens up the flow passage 222 to the intensifier 204. During the overlapping phase, flow to the intensifier 204 is either completely blocked (see FIG. 2) or partially blocked (see the rate shaping embodiment of FIG. 3*b*). The blocking of significant flow into the intensifier piston chamber 223, results in the motion of the intensifier piston 236 and plunger 228 being substantially restrained or limited. The travel time of the delay piston 12 through the overlap length 18 indicates the time delay between control valve 202 opening and the start of the intensifier piston 236 downward motion.

Once the delay piston 12 passes its overlapping phase 18, the flow passageway 222 gradually opens up as the delay piston travels downward to expose an ever increasing portion of the passageway 222 and significant actuating fluid flow between the control valve 202 and the intensifier 204 occurs. The injection process after the piston 12 commences to open the passageway 222 is quite abrupt and comprises the main injection event.

The leakage around the delay piston 12 (between the delay piston 12 and the housing 16) is controlled to be at a minimum flow rate.

There is a very lightly loaded spring 14 on the bottom side of the delay piston 12. This spring 14 has a sole purpose which is to return delay piston 12 to its top position (FIG. 2*a*) after completion of the injection event as signaled by the closing of the control valve 202 close the high pressure actuating fluid from rail 26 vent the actuating fluid to ambient 27. When pressure acting on the top 22 of the delay piston 12 is near ambient pressure level, the pressure on the bottom surface 28 and on the top surface 22 are then balanced and the spring 14 force returns the delay piston 12 upward from the disposition of FIG. 2*b* to its topmost position as depicted in FIG. 2*a*.

The delay piston 12 does not return to its upper, closed position until the intensifier piston 236 finishes its return to its upper initial position (FIG. 2*a*). This results from the delay cylinder spring 14 being relatively weak such that even a minimal pressure on top 22 of the delay piston 12 prevents the delay piston 12 from returning to the full up disposition of FIGS. 1 and 2*a*. Due to a heavy intensifier spring 232 load and drain resistance created by the control valve 202, the pressure acting on the top surface 22 of the delay piston 12 is greater than the ambient pressure level during the intensifier 204 return process. Therefore, the delay piston 12 cannot return when the intensifier piston 236 is returning since the drain pressure on the top surface 22 of the delay piston 12 is greater than force from delay cylinder spring 14. The returning of the delay piston 12 occurs only after the intensifier 204 finishes its return to its upper, initial position, as depicted in FIG. 2*a*.

The time required for the delay piston 12 to travel the overlapping distance 18 can be adjusted to a similar order as the travel time required for the control valve 202 to open. Therefore, with selected calibrated delay piston 12 dimensions, it is possible to achieve virtually any desired delay time to harmonize the control valve signal that acts to command the control valve 202 to open and the intensifier 204 response in commencing downward motion of the intensifier piston 236.

Injector Operation

Before opening commands are given to the control valve 202, all components are at the resting position as depicted in FIGS. 1 and 2*a*. The nozzle needle valve 250 is at its closed position due to the biasing force of the spring 256 on the needle back 257. Accordingly, the orifices 252 are also closed. The intensifier spring 232 is forcing the intensifier piston 236 and the plunger 228 to seat at the topmost position. The plunger chamber 230 is filled with low pressure fuel from fuel rail 231, which connects to a low pressure fuel tank. The intensifier spring cage 233 is always vented to the ambient pressure. The back side chamber 17 of delay piston 12 is also vented to ambient by drain 30. The delay piston 12 top surface 22 is at ambient pressure due to venting of the control valve 202. Therefore, before control valve 202 opens, the delay piston 12 rests at its topmost position due to the spring force of spring 14 and the balanced ambient actuating fluid pressure force on both the top 22 and bottom side 28 of the delay piston is 12. The flow passage 222 between the control valve 202 and intensifier chamber 223 is blocked by the delay piston 12.

A pulse width command is a signal of a certain duration. Initiation of the command opens the control valve 202. The control valve 202 remains open for the duration of the pulse width command and is closed at the termination of the pulse width command. When a pulse width command is given to open the control valve 202, the control valve 12 opens its working port and closes its drain (vent) port. High pressure actuation fluid starts to flow from the high pressure rail 26 through passageway 24 into the delay cylinder chamber 25. The high pressure actuation fluid acts on surface 22, forcing the delay piston 12 to move downward.

The delay piston 12 takes a certain amount of the time to travel through the overlap distance 18 before the delay piston 12 starts to open the flow passage 222. No fuel is injected into the combustion chamber in the interval between the initiation of the pulse width command and the first intersection of the top 22 of the delay piston 12 and the passageway 222. Once the flow passage 222 opens, flow from the control valve 202 to intensifier chamber 223 begins. The high pressure actuation fluid generates a force on the intensifier piston 236 causing the intensifier piston 236 to move downward.

The pressure of the fuel in chamber 230 increases very quickly after the downward motion of the intensifier piston 236 of the intensifier 204 starts to compress the fuel in chamber 230. Injection starts once the pressure of the fuel exceeds the needle valve 250 opening pressure. Meantime, the delay piston 12 continuously travels downward to its bottom seat (FIG. 2*b*) and completely opens the flow passageway 222. When the delay piston 12 is at its bottom seat, the pressure loss caused by the delay device 12 is negligible and the injector flows at substantially similar volume and pressure of fuel as prior art injectors without the delay device 10.

The end of the pulse width command signals the end of the injection event. The control valve 202 returns from its open disposition to its closed disposition, closing its working port and opening its drain port to vent actuating fluid to ambient pressure 27. Actuating fluid in the chamber 223 above the intensifier piston 236 begins the draining process. As actuating fluid pressure in chamber 223 diminishes, the intensifier spring 232 forces the intensifier piston 236 to move back upward. The injection pressure of the fuel drops quickly, resulting in closure of the needle valve 250 and the orifices 252, thereby ending the injection event. During the actuating fluid venting process, the intensifier piston 236 returns to its topmost position (FIG. 2*a*) and refilling of the fuel takes place in chamber 230 beneath the plunger 228. The delay piston 12 then also starts to return to its topmost position (FIG. 2*a*). After the intensifier piston 236 finishes its return, all components are back to the initial positions as depicted in FIGS. 1 and 2*a*.

Advantages of the Present Invention

It is advantageous to interpose a certain delay between an excitation signal to the control valve 202 and a reaction signal to the intensifier 204 in order to obtain better overall system controllability, smoothness of operation and harmonization between components. The delay device of the present invention effects such a delay.

Figure 7:
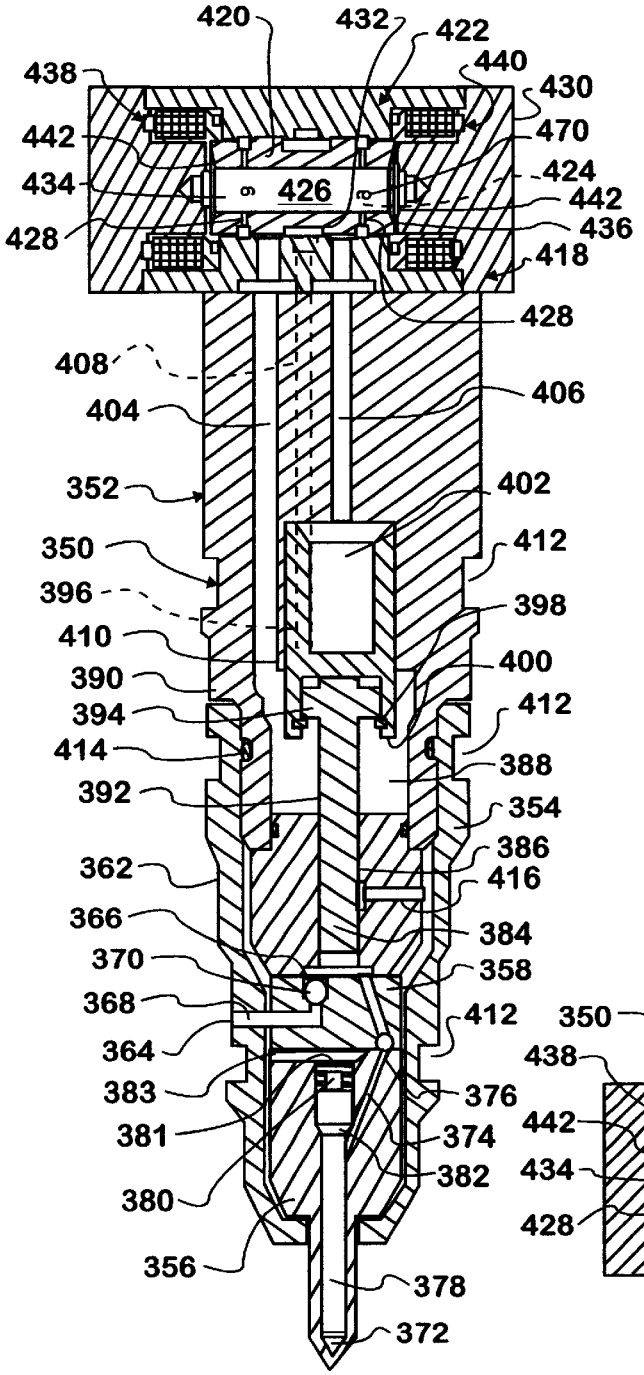
FIG. 7 PRIOR ART
FIG. 7 is a sectional view of a prior art HEUI injector.
Figure 7A:
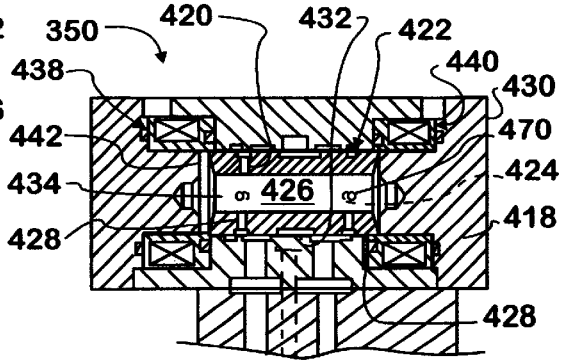
FIG. 7a PRIOR ART
FIG. 7*a* is a sectional view of a prior art HEUI injector control valve.

With the delay device 10 of the present invention, it is possible to build in virtually any desired amount of the delay between the control valve 202 initiation signal and the start of the reaction time from intensifier 204. Overlap 18 is an adjustable and calibratable parameter for any given injector. The delay device 10 permits controllably injecting less fuel than the minimum controllable fuel delivery quantity of a prior art injector as depicted in FIG. 7.

Figure 5A:
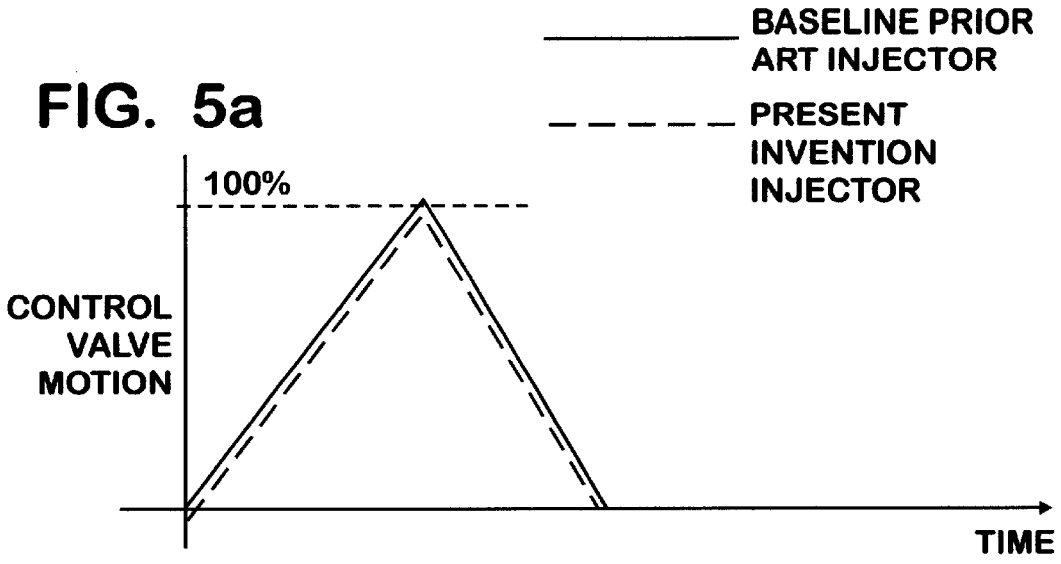
FIG. 5 is three related graphic representations comparing the prior art to the present invention with FIG. 5*a* depicting control valve motion, FIG. 5*b* depicting flow at the intensifier, and FIG. 5*c* depicting injection rate.
Figure 5B:
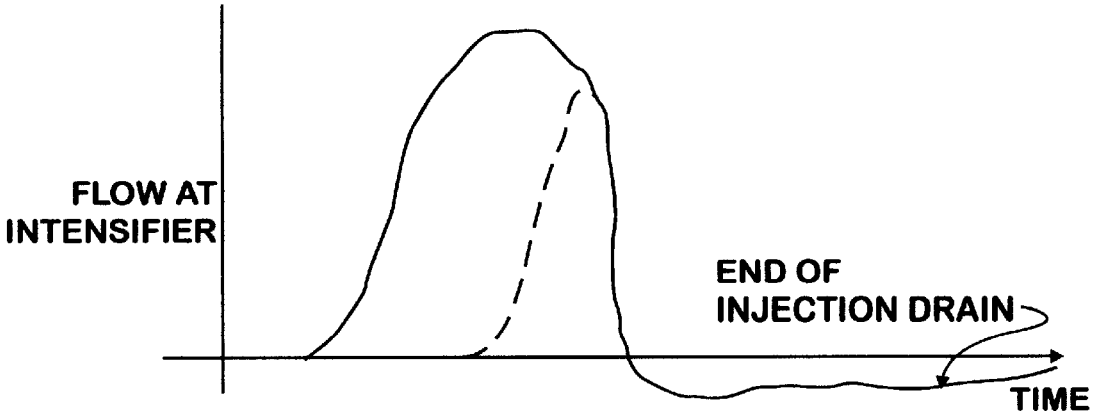
Figure 5C:
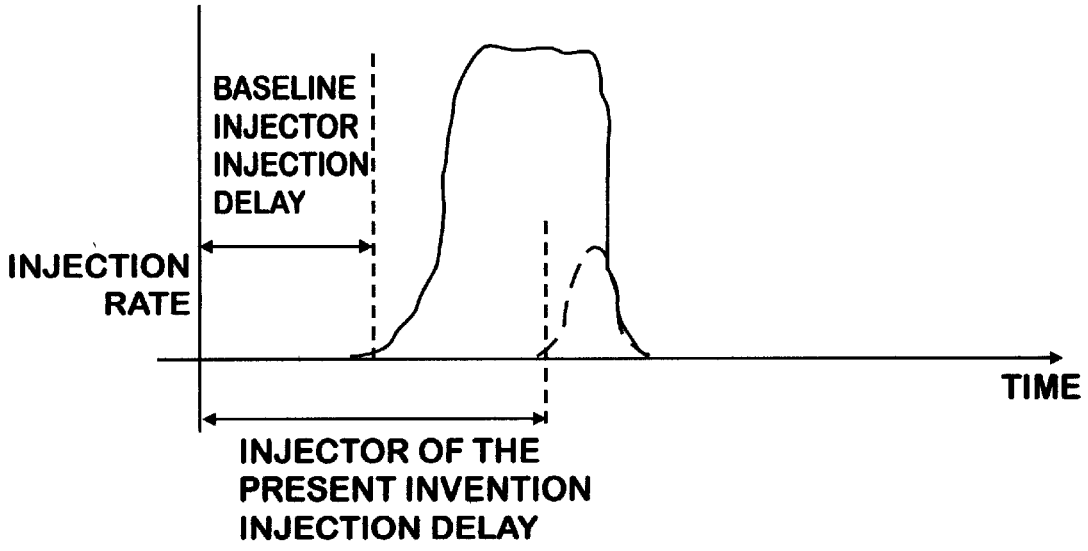

The motion of control valve 202 is relatively independent of rest of the system. With the delay device 10, one can achieve much smaller controllable fuel injection quantity with smaller variability from injection event to injection event. This is illustrated by the figures of FIG. 5. Control valve 202 motion is the same for the prior art injector and the present invention injector, the solid line and the dashed line being in fact coincident in FIG. 5*a* (but being slightly separated in the depiction for clarity of understanding). As the control valve 202 opens, flow to the intensifier 204 starts much earlier in the prior art case compared to the present invention. See FIG. 5*b*. Because of earlier start of intensifier flow in the prior art injector, the start of injection is also very early. See FIG. 5*c*. This results in a relatively larger quantity of fuel delivery at minimum pulse width command. With the present invention, delaying flow to the intensifier produces a relatively longer hydraulic delay between the start of the control valve 202 motion (FIG. 5*a*) and the start of injection (FIG. 5*c*). The longer delay helps to yield the smaller fuel delivery quantity as shown in the FIG. 5*c*. Compared to prior art perfornance, the injector with the present invention produces much smaller fuel delivery for the same given control valve command. This is very desirable for noise emission control and for drivability.

Figure 4:
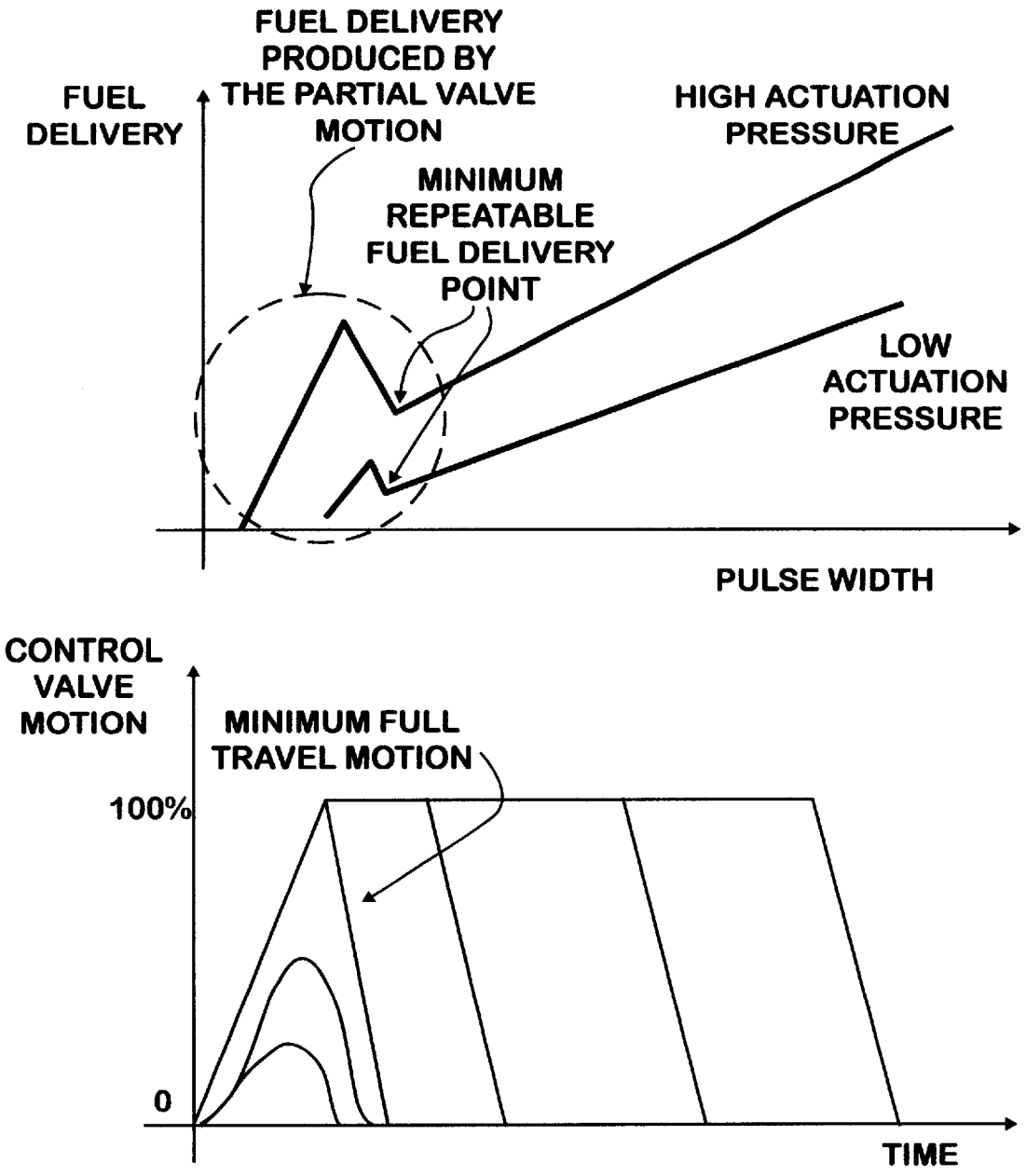
FIG. 4 is two related graphic depictions of the effects of partial valve motion in the prior art HEUI injectors.

Further, by increasing the amount of the overlap 18, the minimum fuel delivery quantity can be reduced to zero, if desired. With the delay device 10, the control valve 202 does not need to work in the partial undesirable motion region at all. See FIG. 4. The control valve 202 may be fully opened for each injection event for the minimum time necessary to fully open and then return to the closed disposition. This is true even for an injection event in which no fuel is injected. All variability and uncontrollability caused by the partial control valve motion of the prior art is eliminated by a suitably calibrated delay device 10 of the present invention.

Another significant advantage of the delay device 10 is that the delay device 10 always opens up the flow passage 222 to the intensifier chamber 223 regardless of the rail pressure in the high pressure rail 26. Since the load of spring 14 is so small, virtually any positive pressure differential acting on surface 22 will force the delay piston 12 to move downward. Whether there is relatively lower or relatively higher rail pressure, delay piston 12 always moves down to open the flow passage 222 for the intensifier 204. This is advantageous under engine operating conditions with relative low actuating fluid pressure.

Yet another advantage of the delay device 10 compared to the stepped intensifier piston shown in U.S. Pat. No. 5,826,562 is that under cold temperature conditions, for example, during a cold start-up, the delay device 10 of the present invention always opens up the flow passage 222 to the intensifier chamber 222 regardless of low pressures at the top surface of the delay piston 12 because there is very low resistance to movement of the delay piston 12 due to the weak spring 14 and further because it is a separate component and thus does not have to also move the intensifier piston 236 against both the force of its spring 232 and the hydraulic resistance in the plunger chamber 230. With a stepped intensifier piston, as described in the '562 patent, the passage to the main intensifier piston surface is more difficult to open especially with highly viscous lubricating oil as the actuating fluid. The present invention is thus very different from the prior art injector of U.S. Pat. No. 5,826,562. In the present invention, the delay piston 12 motion is totally independent of intensifier 204 motion.

OTHER PREFERRED EMBODIMENTS

Rate Shaping Feature

Figure 3A:
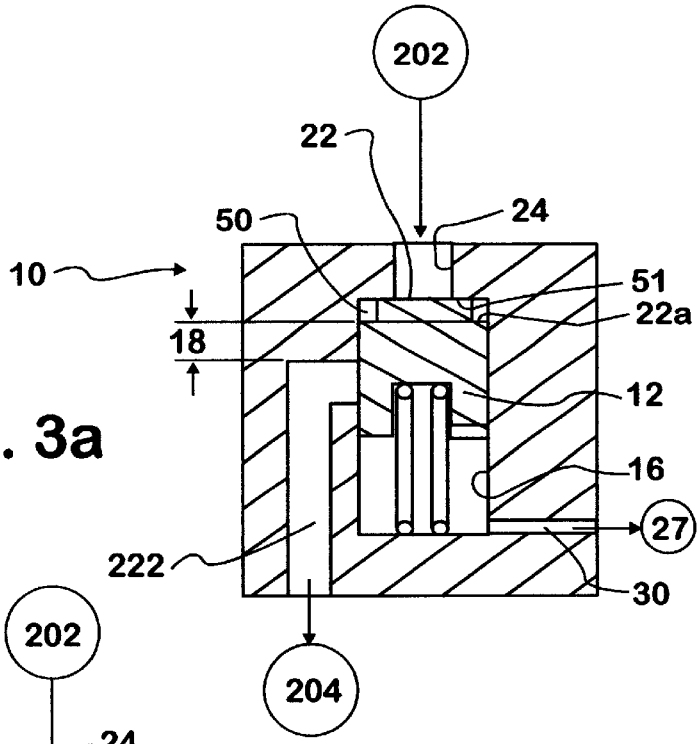
FIG. 3*a* is a sectional view of a delay device used for rate shaping prior top injection.

As shown in FIG. 3*a,* the top portion of the delay piston 12 has a slightly smaller diameter to form a cylindrical peripheral slot 50 defined between the cylinder 51 and the cylinder wall 16. Incoming high pressure actuating fluid bears first on the top surface 22 and, after slight downward translation of the delay piston 12, additionally on the top surface 22*a.* With this slot 50, delay initially occurs during the time it takes for the delay piston 12 to travel the distance of the overlap 18.

Figure 3B:
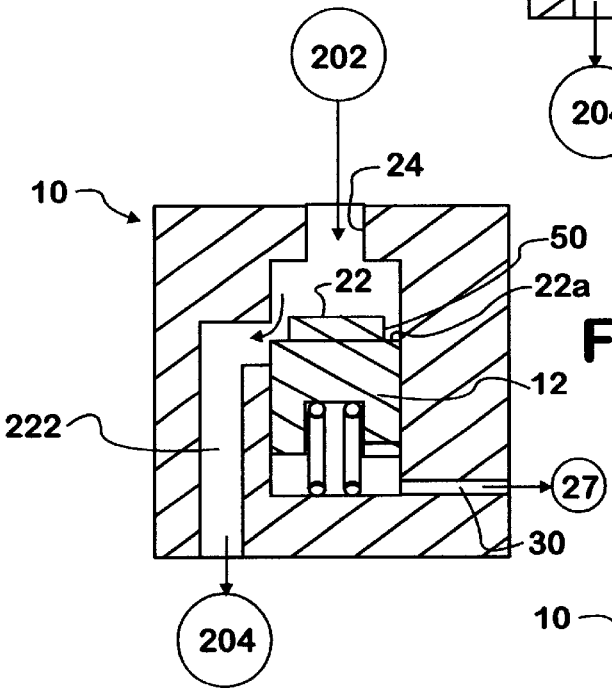
FIG. 3*b* is a sectional view of a delay device of FIG. 3*a* during rate shaping injection.
Figure 3C:
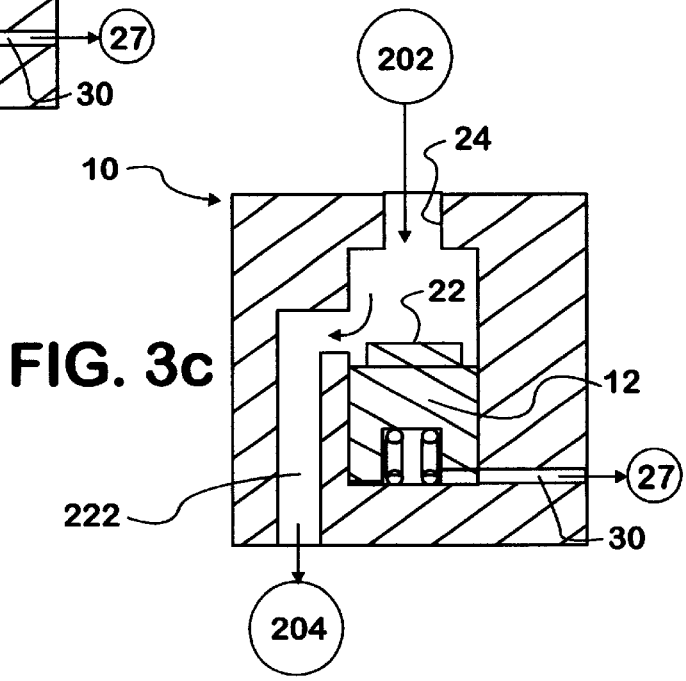
FIG. 3*c* is a sectional view of a delay device of FIG. 3*a* during main injection.
Figure 3D:
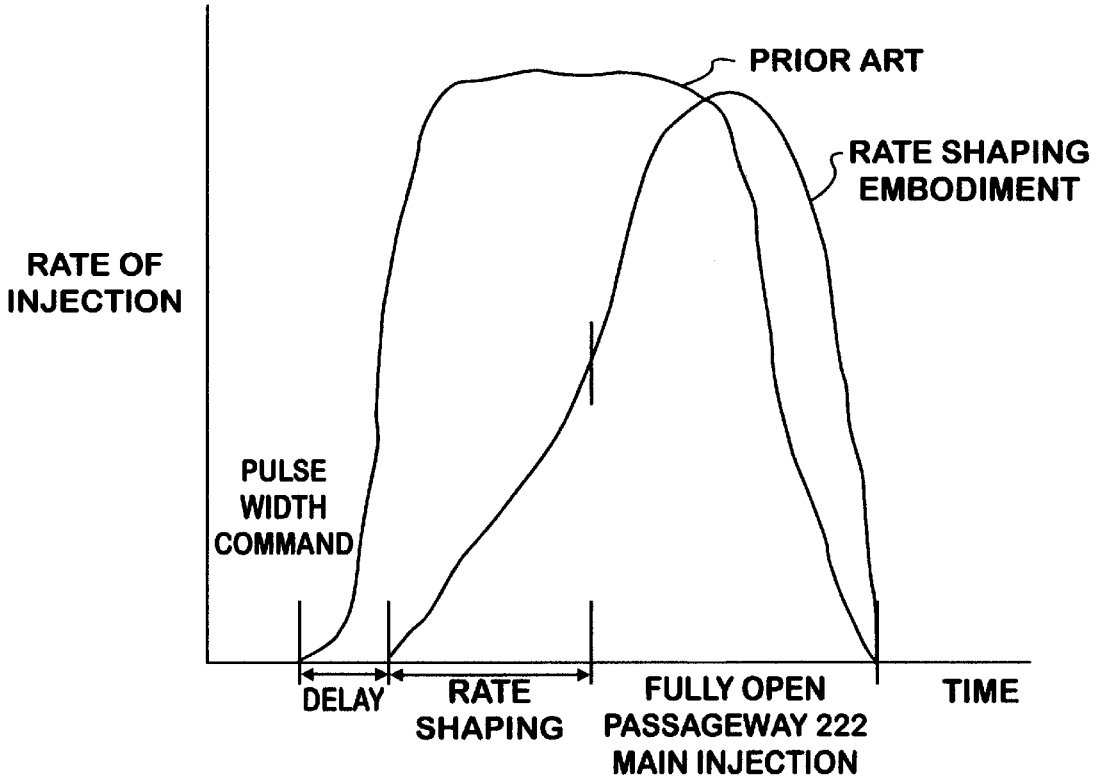
FIG. 3*d* is a graphic representation of the delay and rate shaping effected by the embodiment of FIGS. 3*a*–3*c;*

As indicated by FIG. 3*b,* flow to the intensifier 204 starts slowly at beginning when the slot 50 first intersects the passageway 222 when the top surface 22*a* first intersects the passageway 222. Flow is minimized due to the relatively limited flow area presented by the constriction of the slot 50. Such restriction decreases the slope of the leading edge of the delivered fuel curve on a graph of injection rate versus time. A more gradual building of the rate of injection as compared to the nearly square shape (as depicted in the prior art curve of FIG. 3*c*) is very desirable for engine drivability and emission control. As noted in FIG. 3*d,* the rate shaping embodiment of the present invention includes a delay between the time of the pulse width command initiation and the commencement of injection. The initial portion of injection (after the delay) is rate shaped as the actuating fluid is flowing through the constriction formed by the slot 50. In this region, the rate of injection builds gradually before, as indicated in FIG. 3*c,* the flow passageway 222 is fully opened by further downward motion of delay piston 12 when the top surface 22 passes the leading edge of the passageway 222. This creates a relatively slow rising of injection pressure to provide a rate shaping of the rate of injection of the injected fuel before the sharp rising of main injection event. Slow rising of initial injection pressure is very desirable for NOx emission control. This embodiment allows both delay and rate shaping to occur on one injector.

Figure 3E:
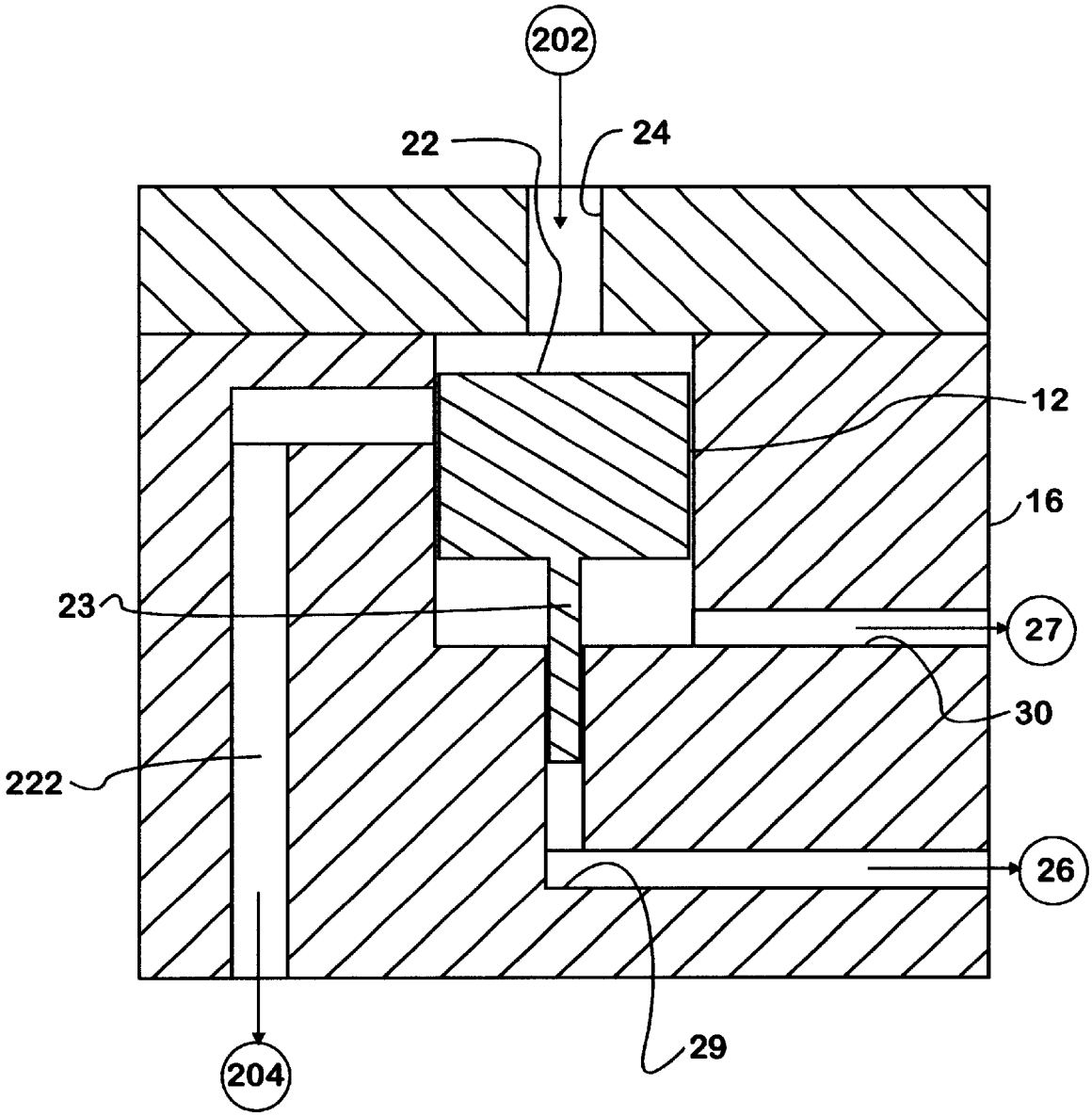
FIG. 3*e* is a sectional view of a delay device using rail pressure to return the delay piston.

FIG. 3*e* illustrates yet another embodiment of the delay device 10 wherein the return spring 14 of the previous embodiments is eliminated. The high pressure actuation fluid from rail 26 is used to return the delay piston 12 to its uppermost position after each injection event. The delay device 10 consist three pieces, the delay piston 12, a return pin 23 and the housing 16. The return pin 23 is slidably disposed in a relatively close fit in a passage 29 disposed in the housing 16 between back side chamber 17 and fluidly connected to the high pressure rail 26, the fit being sufficiently close to prevent significant leakage from the high pressure rail to the back side chamber 17. The pin 23 extends into the backside chamber 17 to be in constant contact with the lower surface 28 of the delay piston 12 as long as rail pressure is available. The back side chamber 17 is vented to ambient pressure at all times. The cross-sectional area of the return pin 23 is relatively small compared to that of the piston 12. Therefore, the return of the delay piston 12 to its uppermost position occurs only when the pressure on the top side 22 of the piston 12 is near ambient pressure.

The advantage of using rail pressure is to provide the delay piston 12 with a variable hydraulic return spring force. As discussed above, the rail pressure 26 may be varied by the engine control microprocessor within a range of 500–4000 psi depending on load and speed conditions. With a spring, the delay piston will travel faster under higher rail pressure conditions. However, the overlap 18 then needs to be relatively large for a given time delay requirement. When rail pressure is used in accordance with this embodiment, the biasing force on the return pin 23 is also increased; hence the delay piston motion at higher rail pressure is slower than with a spring case and the overlap length can be designed to be relatively short and significantly reduce the size of the injector.

Delay Device Inside of the Intensifier

Figure 6A:
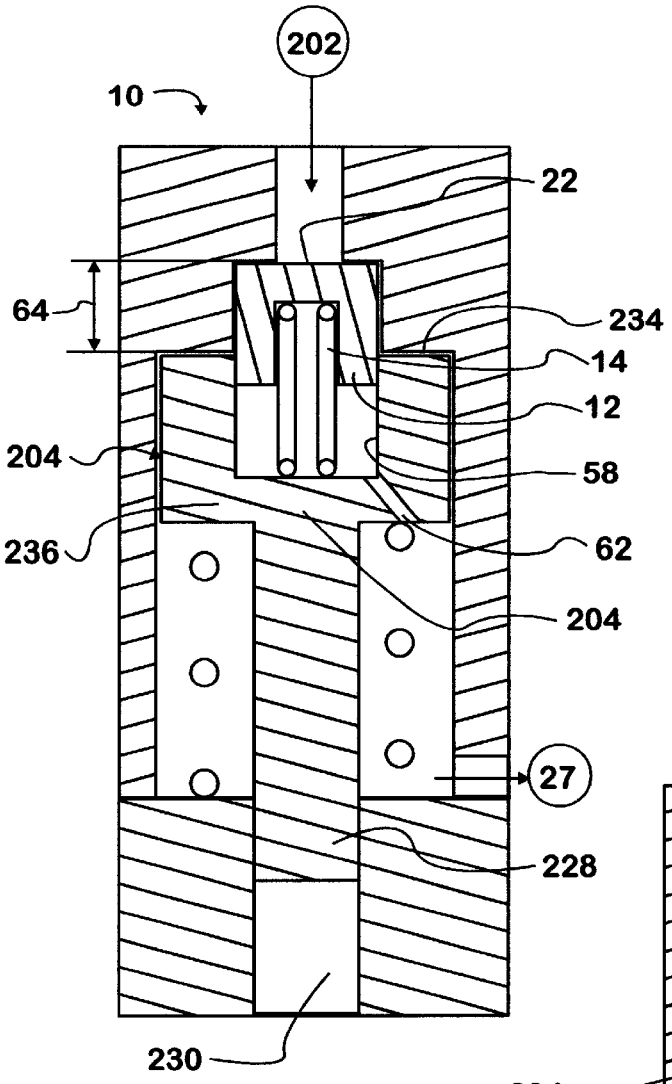
FIG. 6*a* is a sectional view of a further embodiment of the delay device of the present invention prior to injection.
Figure 6B:
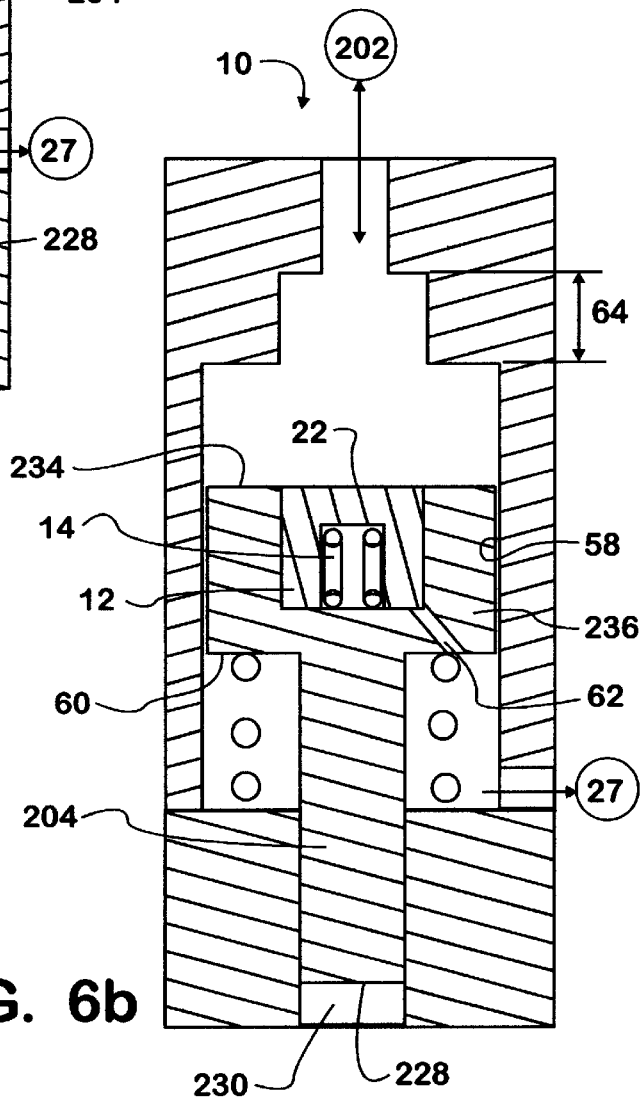
FIG. 6*b* is a sectional view of the delay device of FIG. 6*a* during injection.
Figure 6C:
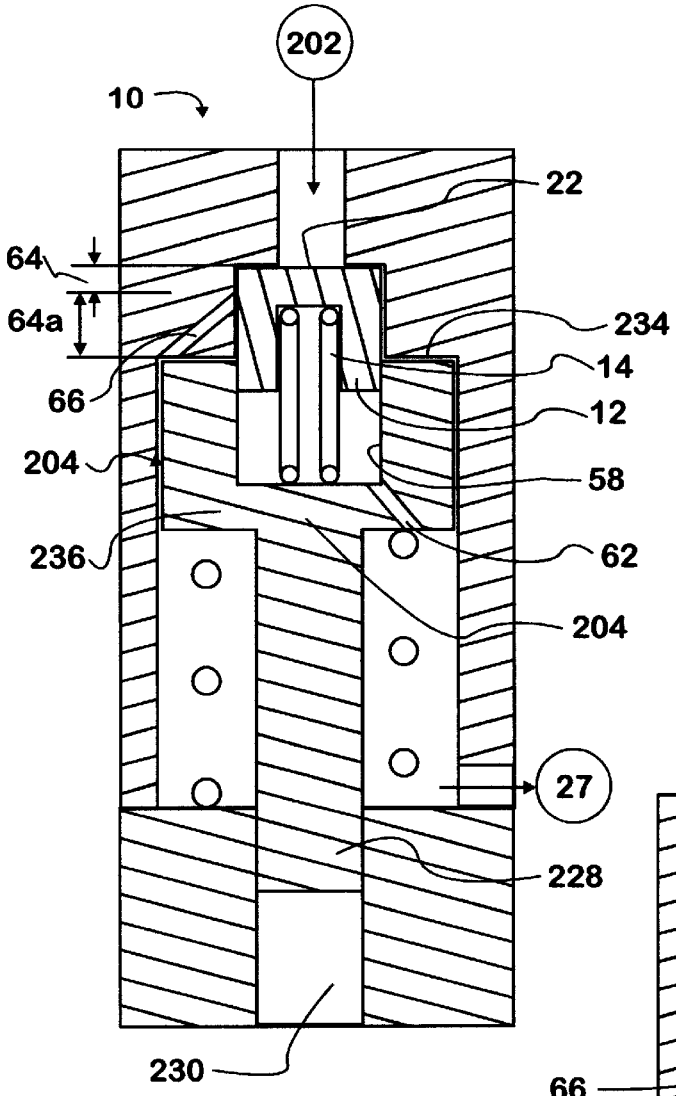
FIG. 6*c* is a sectional view of a further embodiment of the delay device of FIG. 6*a* of the present invention with rate shaping.
Figure 6D:
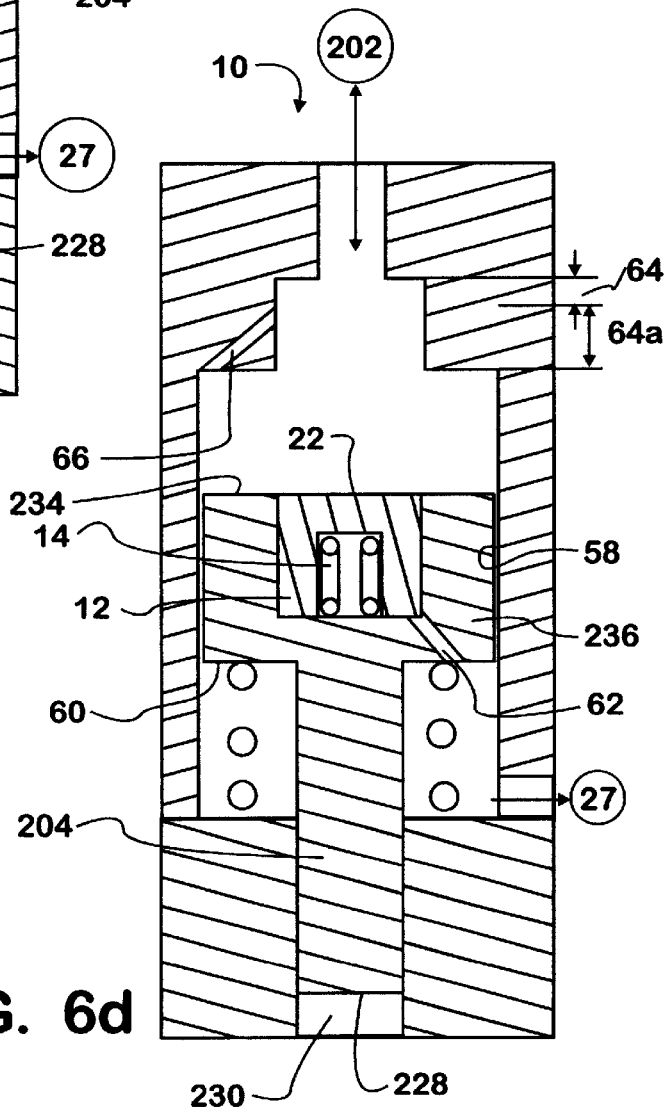
FIG. 6*d* is a sectional view of the delay device of FIG. 6*c* during injection.

As shown in FIGS. 6*a*–6*d,* the delay device 10 includes a cylinder 58 that is defined inside of the intensifier piston 236 of the intensifier 204. The delay piston 12 is translatably disposed in the cylinder 58, thereby providing a packaging advantage for the parts comprising the delay device 10. The embodiment of FIGS. 6*a,* 6*b* is without rate shaping and the embodiment of FIGS. 6*c*–6*d* is with rate shaping.

In operation of the embodiment of FIGS. 6*a,* 6*b,* the delay piston 12 starts to travel into the cylinder 58 of the intensifier piston 236 when the control valve 202 opens. The bottom 60 of the delay piston 12 is properly vented to ambient pressure by passageway 62. The intensifier piston 236 stays at its top position (see FIG. 6*a*) in a waiting mode before the delay piston 12 travels the delay overlap distance 64 and the top surface of the delay piston 12 is flush with the surface 234 of the intensifier piston 236. The delay piston 12 travels at a relatively high speed and quickly reaches its bottom seating position inside of intensifier piston 236. Once the delay piston 12 is seated within the cylinder portion 58 of the intensifier piston 236 (FIG. 6*b*), the high pressure actuating fluid acts on both the surface 22 of the delay piston 12 and the surface 234 of the intensifier piston 236 to drive the intensifier piston 236 downward, compressing the fuel in chamber 230. High intensifier actuating fluid pressure forces the delay cylinder to stay inside of the cylinder portion 58 of the piston 236 for the rest of the injection event. At the end of the injection event, the high pressure actuating fluid vents to the control valve (FIG. 6*b*) and the spring 14 is then free to return the delay piston 12 to the extended disposition of FIG. 6*a*.

The embodiment of FIGS. 6*c*, 6*d* includes both the delay feature of the delay device 10 and the rate shaping feature of the delay device 10. The intensifier piston 236 stays at its top position (see FIG. 6*c*) in a waiting mode while the delay piston 12 travels the delay overlap distance 64. During the time it takes for the delay piston 12 to travel the delay distance, no fuel injection is occurring. Further translation of the delay piston 12 acts to open the rate shaping passage 66. As the delay piston 12 gradually opens the rate shaping flow passage 66, very restricted flow to the intensifier 204 occurs as a result of the relatively small flow area of the rate shaping passage 66. The limited flow of high pressure actuating fluid causes the intensifier piston 236 to start to move downward. The rate of travel of the intensifier is limited so that the rate of pressure increase of the fuel in the chamber 230 is also limited. Fuel injection commences, but the above noted limitations minimize the rate of increase of the rate of injection as compared to the prior art, thereby effecting rate shaping. Rate shaping occurs during the rate shaping overlap 64*a* until the delay piston 12 is seated downward in the cylinder 58.

Once the delay piston 12 is seated within the cylinder portion 58 of the intensifier piston 236 (FIG. 6*d*), the high pressure actuating fluid acts on both the surface 22 of the delay piston 12 and the surface 234 of the intensifier piston 236 to drive the intensifier piston 236 downward, compressing the fuel in chamber 230. High intensifier actuating fluid pressure forces the delay cylinder to stay inside of the cylinder portion 58 of the piston 236 for the main injection portion of the of the injection event. At the end of the injection event, the high pressure actuating fluid vents to the control valve (FIG. 6*d*) and the spring 14 is then free to return the delay piston 12 to the extended disposition of FIG. 6*a*.

Delay Device Inside of the Intensifier With Pilot Injection

Figure 6E:
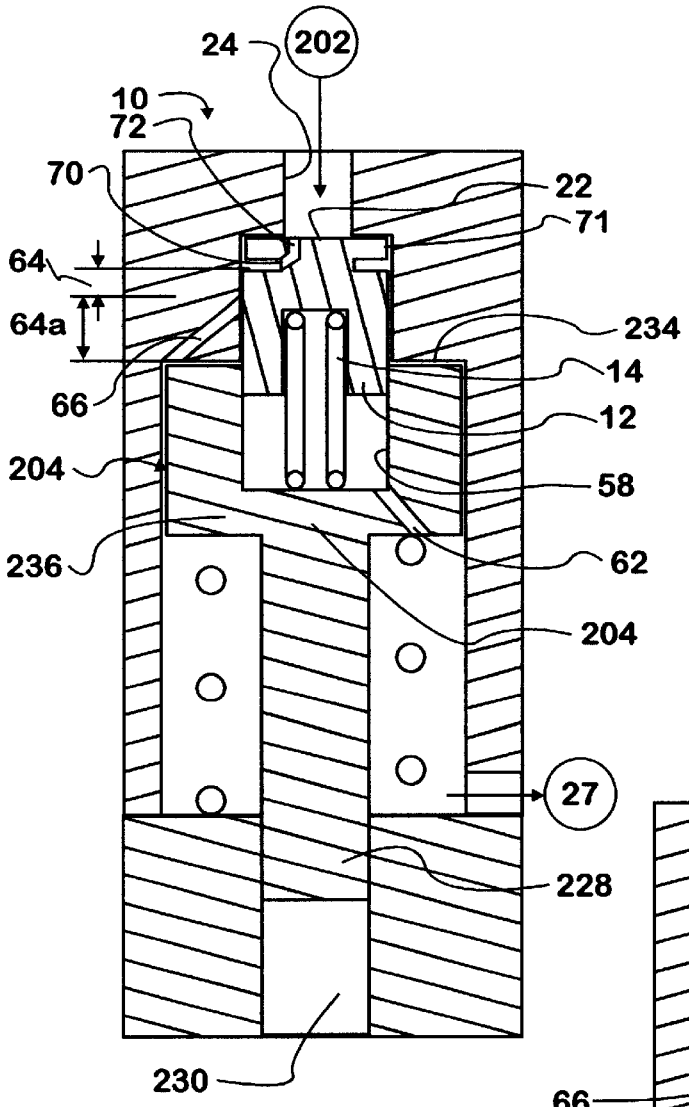
FIG. 6*e* is a sectional view of a further embodiment of the delay device of the present invention with pilot injection prior to main injection.
Figure 6F:
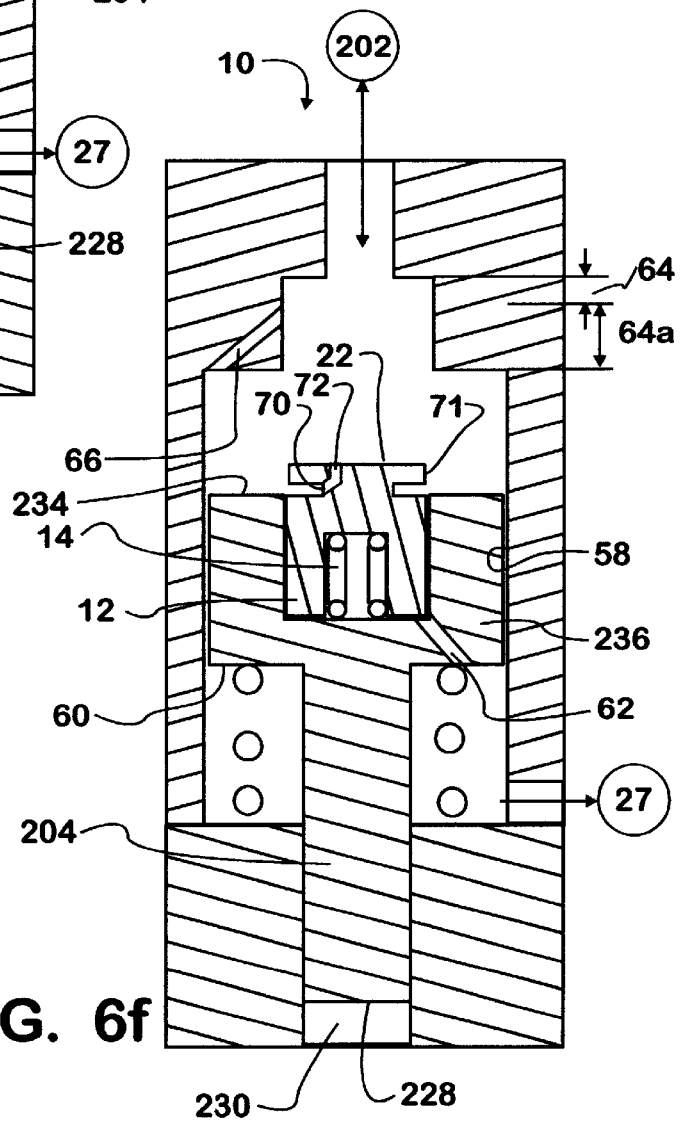
FIG. 6*f* is a sectional view of the delay device of FIG. 6*e* during injection.

The embodiment of FIGS. 6*e*, 6*f* includes both the delay feature of the delay device 10 and a pilot injection feature of the delay device 10. The delay device 10 includes a piston 12 having a circumferential groove 70 defined in the piston, spaced apart form the top surface 22 by a land 71. A flow passage 72 extends form the top surface 22 through the land 71 to the groove 70.

In operation, high pressure actuating fluid in the passage 24 from the control valve 212 bears on the top surface 22 and flows through the flow passage 72 to pressurize the groove 70. The piston 12 commences downward translation. The intensifier piston 236 stays at its top position (see FIG. 6*e*) in a waiting mode while the delay piston 12 travels the delay overlap distance 64. During the time it takes for the delay piston 12 to travel the delay distance 64, no fuel injection is occurring. Further translation of the delay piston 12 acts to open the passage 66 to the groove 70. As the delay piston 12 gradually opens the flow passage 66, very restricted flow to the intensifier 204 occurs as a result of the relatively small flow area of the rate shaping passage 66. The limited flow of high pressure actuating fluid causes the intensifier piston 236 to start to move downward. The rate of travel of the intensifier is limited so that the rate of pressure increase of the fuel in the chamber 230 is also limited. Fuel injection commences, but the above noted limitations minimize the rate of increase of the rate of injection as compared to the prior art. Pilot injection commences at this point in the injection event.

Further downward translation of the piston causes the land 71 to seal the passage 66. This momentarily terminates actuating pressure to the intensifier piston 236, causing a pause in the translation of the intensifier passage 236. Such pause substantially terminates injection until the land 71 passes the flow passage 66. Pilot injection terminates with the aforementioned end of injection.

Once the delay piston 12 is seated within the cylinder portion 58 of the intensifier piston 236 (FIG. 6*f*), the high pressure actuating fluid acts on both the surface 22 of the delay piston 12 and the surface 234 of the intensifier piston 236 to drive the intensifier piston 236 downward, greatly compressing the fuel in chamber 230, thereby commencing the main injection portion of the injection event. High intensifier actuating fluid pressure forces the delay cylinder 12 to stay inside of the cylinder portion 58 of the piston 236 for the main injection portion of the of the injection event. It should be noted that the skirt of the piston 12 may be trimmed so that the piston top surface 22 is flush with the surface 236, as in FIG. 6*b*.

At the end of the injection event, the high pressure actuating fluid vents to the control valve (FIG. 6*f*) and the spring 14 is then free to return the delay piston 12 to the extended disposition of FIG. 6*e*.

While a number of presently preferred embodiments of the invention have been illustrated and described, it should be appreciated that the inventive principles can be applied to other embodiments falling within the scope of the following claims.

What is claimed is:

1. A delay device for use with a fuel injector, the fuel injector having an electrically actuated controller for controlling a flow of a high pressure actuating fluid responsive to initiation and cessation of a pulse width command, the pulse width command defining the duration of an injection event, and an intensifier being in fluid communication with the controller, the intensifier being translatable to increase the pressure of a volume of fuel for injection into the combustion chamber of an engine; the delay device comprising:

a delay apparatus, shiftable between a first disposition and a second disposition over a certain period of time after initiation of the pulse width command, at least a portion of the period of time effecting a delay in initiation of fuel injection after initiation of the pulse width command, the shifting of the delay apparatus being independent of the translator motion of the intensifier.

2. The delay device of claim 1 wherein the controller is shiftable between a closed disposition and an open disposition, the delay in initiation of fuel injection being related to a period of time necessary for the controller to complete a round trip between the closed disposition and the open disposition.

3. The delay device of claim 2 further effecting rate shaping of the injection event.

4. The delay device of claim 1 being fluidly interposed between the controller and the intensifier to affect the fluid communication therebetween.

5. The delay device of claim 4 wherein the apparatus acts to delay a flow of high pressure actuating fluid from the controller to the intensifier.

6. A delay device for use with a fuel injector, the fuel injector having an electrically actuated controller for controlling a flow of a high pressure actuating fluid responsive to initiation and cessation of a pulse width command, the pulse width command defining the duration of an injection event, and an intensifier being in fluid communication with the controller, the intensifier being translatable to increase the pressure of a volume of fuel for injection into the combustion chamber of an engine; the delay device comprising:

a delay apparatus, shiftable between a first disposition and a second disposition over a certain period of time after initiation of the pulse width command, at least a portion of the period of time effecting a delay in initiation of fuel injection after initiation of the pulse width command, the delay apparatus being fluidly interposed between the controller and the intensifier to affect the fluid communication between the controller and the intensifier, the delay apparatus acting to delay a flow of high pressure actuating fluid from the controller to the intensifier wherein the shifting of the apparatus is independent of the translatory motion of the intensifier.

7. The delay device of claim 1 wherein the apparatus is biased in the first disposition.

8. The delay device of claim 7 wherein the apparatus shifts from the first disposition responsive to high pressure actuating fluid generating a force on the apparatus in opposition to the bias.

9. The delay device of claim 8 wherein the apparatus is disposed relative to a fluid passageway, the fluid passageway being in fluid communication with the intensifier, such that shifting of the apparatus acts to open and close the fluid passageway.

10. A delay device for use with a fuel injector, the fuel injector having an electrically actuated controller for controlling a flow of a high pressure actuating fluid responsive to initiation and cessation of a pulse width command, the pulse width command defining the duration of an injection event, and an intensifier being in fluid communication with the controller, the intensifier being translatable to increase the pressure of a volume of fuel for injection into the combustion chamber of an engine; the delay device comprising:

a delay apparatus, shiftable between a first disposition and a second disposition over a certain period of time after initiation of the pulse width command, at least a portion of the period of time effecting a delay in initiation of fuel injection after initiation of the pulse width command, the delay apparatus being biased in the first disposition and shifts from the first disposition responsive to high pressure actuating fluid generating a force on the apparatus in opposition to the bias, the delay apparatus shifting from the first disposition responsive to high pressure actuating fluid generating a force on the apparatus in opposition to the bias wherein the delay apparatus is a piston translatably disposed in a cylinder, the fluid passageway intersecting the cylinder.

11. The delay device of claim 1, the delay apparatus being a piston translatably disposed in a cylinder, a fluid passageway intersecting the cylinder wherein the piston is biased in a first disposition by a spring acting thereon.

12. The delay device of claim 10 wherein the piston is biased in the first disposition by high pressure actuating fluid.

13. The delay device of claim 12 wherein the piston is biased by a pin have a first portion in contact with said piston and a second portion exposed to said high pressure actuating fluid.

14. The delay device of claim 10 wherein the cylinder is defined at least in part in an injector housing.

15. The delay device of claim 10 wherein the cylinder is defined at least in part in an intensifier piston.

16. A fuel injector, comprising:

an electrically actuated controller for controlling the flow of a high pressure actuating fluid responsive to initiation and cessation of a pulse width command, the pulse width command defining the duration of an injection event;

an intensifier being in fluid communication with the controller, the intensifier being translatable to increase the pressure of a volume of fuel for injection into the combustion chamber of an engine;

a delay device, shiftable between a first disposition and a second disposition over a certain period of time after initiation of the pulse width command, at least a portion of the period of time effecting a delay in initiation of fuel injection after initiation of the pulse width command, the shifting of the delay device being independent of the translatory motion of the intensifier.

17. The fuel injector of claim 16 wherein the electric controller is shiftable between a closed disposition and an open disposition, the delay in initiation of fuel injection being related to a period of time necessary for the controller to complete a round trip between the closed disposition and the open disposition.

18. The fuel injector of claim 16 further effecting rate shaping of the injection event.

19. The fuel injector of claim 16 being interposed between the controller and the intensifier to affect the fluid communication therebetween.

20. The fuel injector of claim 19 wherein the delay device acts to delay a flow of high pressure actuating fluid from the controller to the intensifier.

21. The fuel injector of claim 16 wherein the delay device is biased in the first disposition.

22. The fuel injector of claim 21 wherein the delay device shifts from the first disposition responsive to high pressure actuating fluid generating a force on the delay device in opposition to the bias.

23. The fuel injector of claim 22 wherein the delay device is disposed relative to a fluid passageway, the fluid passageway being in fluid communication with the intensifier, such that shifting of the delay device acts to open and close the fluid passageway.

24. The fuel injector of claim 23 wherein the delay device is a piston disposed in a cylinder, the fluid passageway intersecting the cylinder.

25. The fuel injector of claim 24 wherein the piston is biased in the first disposition by a spring acting thereon.

26. The delay device of claim 24 wherein high pressure actuating fluid effects a bias of the piston to the first disposition.

27. The delay device of claim 26 wherein the piston is biased by a member having a first portion in contact with said piston and a second portion exposed to said high pressure actuating fluid.

28. The fuel injector of claim 24 wherein the cylinder is defined at least in part in an injector housing.

29. The fuel injector of claim 24 wherein the cylinder is defined at least in part in an intensifier piston.

30. A method of stabilizing a fuel injection event, comprising the steps of:

sending a pulse width command to a controller to define an injection event;

the controller porting an actuating fluid to affect an intensifier responsive to reception of the pulse width command; and interposing a delay in the actuating fluid affecting the intensifier, the delay being effected by selectively opening and closing an actuating fluid passageway by means of the translatory motion of a delay piston.

31. The method of claim 30 wherein the duration of the delay is at least equal to the time required for the controller to complete a round trip between a closed disposition and an open disposition.

32. The method of claim 31 wherein a period of injection rate shaping follows the period of delay.

33. The method of claim 30 wherein the translatory motion of the delay piston is effected in part by a force generated by the actuating fluid acting on the piston.

34. The method of claim 33 wherein the translatory motion of the delay piston is independent of a translatory motion of an intensifier piston.

35. The method of claim 34 wherein the delay piston is translated between a first seated disposition and a second seated disposition during an injection event, the intensifier piston being translated between a first seated disposition and a second seated disposition during an injection event, the delay piston returning to the first seated disposition subsequent to the intensifier piston returning to the first seated disposition at the termination of the injection event.

36. The method of claim 33 further comprising hydraulically biasing the delay piston to the first disposition, the hydraulic biasing force increasing as the force generated by the actuating fluid acting on the piston to effect the translatory movement increases.

37. The method of claim 36 wherein the hydraulic biasing of the piston is effected by a member exposed to said high pressure actuating fluid.

38. A fuel injector, comprising:

an electrically actuated controller for controlling the flow of a high pressure actuating fluid responsive to initiation and cessation of a pulse width command, the pulse width command defining the duration of an injection event;

an intensifier being in fluid communication with the controller, the intensifier being translatable to increase the pressure of a volume of fuel for injection into the combustion chamber of an engine, the intensifier having an intensifier piston disposed in a cylinder defined in an injector housing;

a delay device, shiftable between a first disposition and a second disposition over a certain period of time after initiation of the pulse width command, the period of time effecting a delay in initiation of fuel injection after initiation of the pulse width command, the delay device including a delay piston translatably disposed at least in part in a first delay piston cylinder, the piston cylinder being defined at least in part in the injector housing.

39. The injector of claim 38 further including a first actuating fluid passageway defined in the injector housing, the first actuating fluid passageway fluidly coupling the electric controller to the delay piston, fluid pressure in the first actuating fluid passageway acting to generate a force on the delay piston for imparting translatory motion thereto.

40. The injector of claim 39 further including a second actuating fluid passageway defined in the injector housing, the second actuating fluid passageway fluidly coupling the delay piston to the intensifier piston, fluid pressure in the second actuating fluid passageway acting to generate a force on the intensifier piston for imparting translatory motion thereto.

41. The injector of claim 40 wherein the second actuating fluid passageway intersects the delay piston cylinder between a first disposition of the delay device and a second disposition.

42. The injector of claim 41 wherein the second actuating fluid passageway is substantially sealed by the delay piston when the delay piston is in the first disposition.

43. The injector of claim 42 wherein translation of the delay piston from the first disposition toward the second disposition acts open the second actuating fluid passageway after a selected distance of delay piston travel.

44. The injector of claim 43 wherein the second actuating fluid passageway has a relatively small flow area for restricting the volume of actuating fluid available, such restriction effecting a rate shaped injection event.

45. The injector of claim 38 wherein the delay piston is translationally disposed at least in part in a second delay piston cylinder, the second delay piston cylinder being defined in the intensifier piston.

46. The delay device of claim 2 further effecting pilot injection prior to a main injection of the injection event.

47. The delay device of claim 16 further effecting pilot injection prior to a main injection of the injection event.

48. The method of claim 31 wherein a period of pilot injection follows the period of delay.

* * * * *